US009352553B1

(12) United States Patent
Tsuno et al.

(10) Patent No.: US 9,352,553 B1
(45) Date of Patent: May 31, 2016

(54) PRINTING APPARATUS, PRINTING METHOD, AND MANUFACTURING METHOD OF PRINTED MATTER

(71) Applicant: FUJI XEROX CO., LTD., Tokyo (JP)

(72) Inventors: Tomohiko Tsuno, Kanagawa (JP); Takahiro Sano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/694,404

(22) Filed: Apr. 23, 2015

(30) Foreign Application Priority Data

Dec. 12, 2014 (JP) ..... 2014-252423

(51) Int. Cl.
*B41L 3/02* (2006.01)
*B41F 33/00* (2006.01)

(52) U.S. Cl.
CPC ..... *B41F 33/0036* (2013.01)

(58) Field of Classification Search
CPC ..... B41F 33/0036
USPC ..... 101/486
See application file for complete search history.

(56) References Cited

U.S. PATENT DOCUMENTS 5,014,618 A * 5/1991 Zingher ..... B41F 33/0036 101/365
7,891,292 B2 * 2/2011 Takahashi ..... B41L 13/06 101/116
2005/0058493 A1 * 3/2005 Kida ..... B41J 13/0045 400/579
2009/0033015 A1 * 2/2009 Taguchi ..... B41L 43/02 270/1.01
2009/0226232 A1 9/2009 Scholzig
2010/0005991 A1 * 1/2010 Yoshida ..... B41J 11/42 101/486
2012/0070214 A1 * 3/2012 Okutsu ..... G03G 15/6508 399/388
2012/0229534 A1 * 9/2012 Umetsu ..... B41J 2/2142 347/2
2012/0248235 A1 * 10/2012 Inoue ..... B26D 5/34 242/562

FOREIGN PATENT DOCUMENTS

JP 2009-519842 A 5/2009

* cited by examiner

*Primary Examiner* — Anthony Nguyen
(74) *Attorney, Agent, or Firm* — Oliff PLC

(57) ABSTRACT

Provided is a printing apparatus including a positioning unit that positions a print object, a printing unit that prints a predetermined print image on the print object after elapse of a predetermined standby time since the print object is positioned by the positioning unit, and a controller that adjusts the standby time depending on quality of the print image printed on the print object by the printing unit, and controls the printing unit so as to print the print image on a subsequent print object after the elapse of the adjusted standby time.

17 Claims, 15 Drawing Sheets

FIG. 13

82

| GRADE | ADDITION AND SUBTRACTION TIME (SECOND) |
|---|---|
| A | -0.2 |
| B | -0.1 |
| C | 0 |
| D | 0.1 |
| E | 0.2 |

FIG. 15

84

| GRADE | ADDITION TIME (SECOND) |
|---|---|
| A | ----- |
| B | ----- |
| C (THRESHOLD) | 0.1 |
| D | 0.2 |
| E | 0.3 |

PRINTING APPARATUS, PRINTING METHOD, AND MANUFACTURING METHOD OF PRINTED MATTER

CROSS-REFERENCE TO RELATED APPLICATIONS

This application is based on and claims priority under 35 USC 119 from Japanese Patent Application No. 2014-252423 filed Dec. 12, 2014.

BACKGROUND

Technical Field

The present invention relates to a printing apparatus, a printing method, and a manufacturing method of a printed matter.

SUMMARY

In a case of successively performing printing on plural print objects, in order to shorten a cycle time, it is desirable to shorten a standby time from the positioning of the print object to the start of printing as much as possible. However, if the standby time is excessively short, the printing may be started in some cases even though the positioning is not completed, and thus the print quality becomes lower.

According to an aspect of the invention, there is provided a printing apparatus including:

a positioning unit that positions a print object;

a printing unit that prints a predetermined print image on the print object after elapse of a predetermined standby time since the print object is positioned by the positioning unit; and a controller that adjusts the standby time depending on quality of the print image printed on the print object by the printing unit, and controls the printing unit so as to print the print image on a subsequent print object after the elapse of the adjusted standby time.

BRIEF DESCRIPTION OF THE DRAWINGS

Exemplary embodiments of the present invention will be described in detail based on the following figures, wherein:

FIG. 13 is a configuration diagram illustrating an example of correspondence information according to the second exemplary embodiment;

FIG. 15 is a configuration diagram illustrating an example of correspondence information according to the third exemplary embodiment.

DETAILED DESCRIPTION

Below, exemplary embodiments of the present invention will be described in detail, with reference to the drawings.

First Exemplary Embodiment

First, a printing apparatus according to a first exemplary embodiment will be described.

Figure 1:
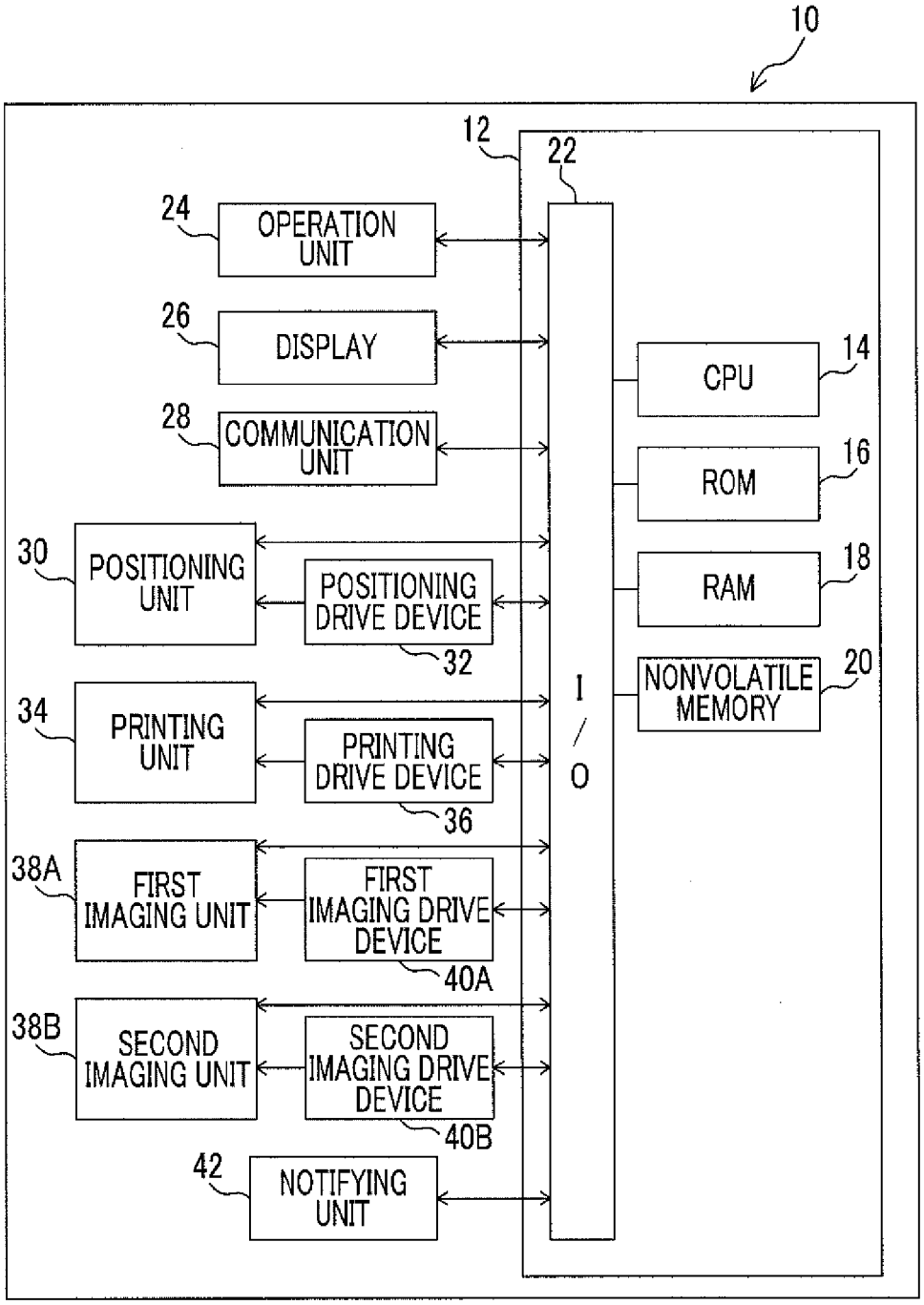
FIG. 1 is a block diagram illustrating an electrical configuration of a printing apparatus according to an exemplary embodiment.

As illustrated in FIG. 1, a printing apparatus 10 according to the present exemplary embodiment includes a controller 12 that performs overall control of the entire apparatus. Further, the controller 12 includes a central processing unit (CPU) 14 that executes various processes including a printing process described later, and a read only memory (ROM) 16 that stores programs and various types of information which are used in the process of the CPU 14. Further, the controller 12 includes a random access memory (RAM) 18 that temporarily stores each type of information as a work area of the CPU 14, and a nonvolatile memory 20 that stores each type of information used in the process of the CPU 14. Further, the controller 12 includes an input/output (I/O) interface 22 that inputs and outputs information to/from an external device connected to the printing apparatus 10.

The I/O interface 22 is connected to an operation unit 24 operated by a user, a display 26 that, for example, performs indication on a display and color indication using indicating lights (Patlite (registered trademark), or the like) and a communication unit 28 that performs communication with external devices. Further, the I/O interface 22 is connected to a positioning unit 30 that positions a print object, a positioning drive device 32 that performs driving control of the positioning unit 30, a printing unit 34 that prints a print image on the print object, and a printing drive device 36 that drives the printing unit 34. Further, the I/O interface 22 is connected to a first imaging unit 38A that captures the print image printed on the print object and a first imaging drive device 40A that drives the first imaging unit 38A. Further, the I/O interface 22 is connected to a second imaging unit 38B that captures the print image printed on the print object and a second imaging drive device 40B that drives the second imaging unit 38B. Further, the I/O interface 22 is connected to a notifying unit 42 that notifies the user of various types of information based on the control of the CPU 14.

Figure 2:
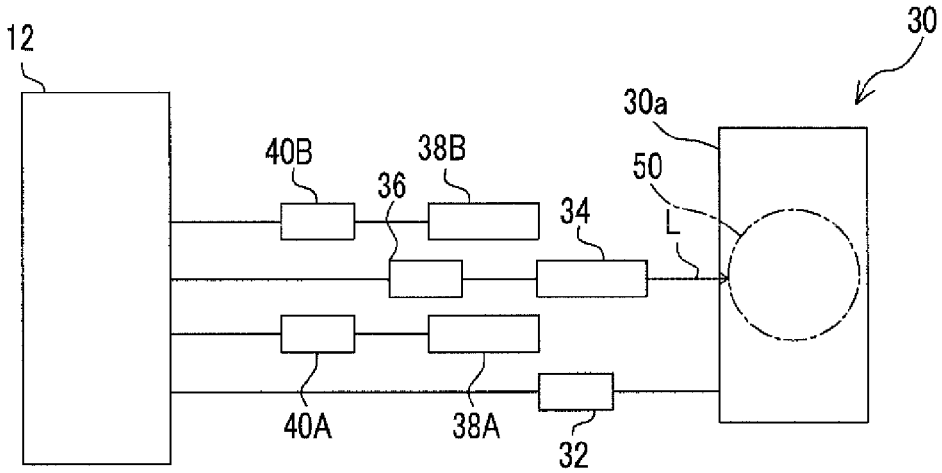
FIG. 2 is a schematic plan view required for a description of a printing process by the printing apparatus according to the exemplary embodiment.

Here, as illustrated in FIG. 2, the positioning unit 30 includes a jig 30*a* for fixing a print object 50 in a predetermined position along a transport path. Further, the printing unit 34 is provided at a position where the printing unit 34 may perform printing on the print object 50 placed in the jig 30*a*. In addition, the first imaging unit 38A and the second imaging unit 38B are provided at a position where the printing surface of the print object 50 placed in the jig 30*a* may be captured. In addition, in the present exemplary embodiment, as an example, a description will be made regarding a case where the print object 50 is a component constituting a portion of a toner cartridge used in an electrophotographic image forming apparatus, and the component is made from a resin that is irradiated with a laser to draw an image and is formed into a cylindrical shape.

In other words, in a state where the print object 50 is placed in the jig 30*a* and then positioned by the positioning unit 30 in a printing object position, printing is performed by the printing unit 34. During the positioning, mutual positioning of the printing object position of the print object 50 and a laser irradiation position by a laser emitting apparatus described later of the printing unit 34 is performed by the positioning unit 30. Further, in a state where the print object 50 is placed in the jig 30*a* after the printing is performed by the printing unit 34, imaging is performed by the first imaging unit 38A and the second imaging unit 38B.

Figure 3:
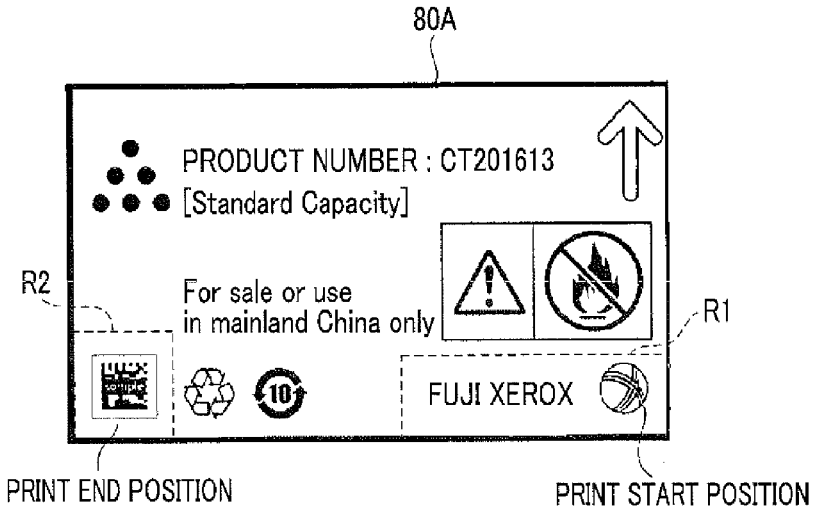
FIG. 3 is a front view illustrating an example of a print image printed by the printing apparatus according to an exemplary embodiment.

The printing unit 34 is the laser emitting apparatus equipped with a laser head for emitting a laser L. The printing unit 34 is driven by the printing drive device 36 so as to change the laser irradiation position based on image information indicating the print image, and draws the print image on the print object 50. When a print image 80A contains plural images as illustrated in FIG. 3 as an example, the printing drive device 36 drives the laser emitting apparatus to draw the plural images along the shortest route. If the resin forming the print object 50 is irradiated with the laser L emitted from the laser head, the front surface of the print object 50 is foamed, unevenness is formed on the surface of the print object 50 and an area irradiated with the laser L is colored by diffuse reflection. Thus, printing on the print object 50 is performed. In the present exemplary embodiment, image information indicating a print image is stored in advance in the nonvolatile memory 20, but without being limited thereto, the image information may be received from the outside through the communication unit 28 and stored in the RAM 18.

The first imaging unit 38A is driven by the first imaging drive device 40A, captures the print image printed on the print object 50 placed in the jig 30*a*, generates image information, and transmits the image information to the CPU 14. Further, similarly, the second imaging unit 38B is driven by the second imaging drive device 40B, captures the print image printed on the print object 50 placed in the jig 30*a*, generates image information, and transmits the image information to the CPU 14.

In the present exemplary embodiment, as illustrated in FIG. 3, the first imaging unit 38A captures a start position region R1 that is a region of a portion of the print image 80A and includes a print start position. Further, in the present exemplary embodiment, as illustrated in FIG. 3, the second imaging unit 38B captures an end position region R2 that is a region of a portion of the print image 80A and includes a print end position. Since the first imaging unit 38A and the second imaging unit 38B capture a portion of the print image in this manner, there is an advantage that the number of pixels (for example, each has 300,000 pixels) is smaller than that of an imaging unit capable of capturing the entire print image 80A and cost is reduced. Further, in the case of capturing an entire three-dimensional object, the end of the object is likely to be distorted, but capturing a portion of the print image allows the generation of the distortion to be suppressed.

The notifying unit 42 is configured to include at least one of, for example, a beep generating device that generates a beep in response to the control of the CPU 14, a sound generating device that generates a sound in response to the control of the CPU 14, and a vibration device that vibrates in response to the control of the CPU 14. Then, the notification by the notifying unit 42 is performed by using the beep generated by the beep generating device, the sound generated by the sound generating device, the vibration generated by vibration device, and the indication on the display 26.

Next, a specific method in which the positioning unit 30 positions the print object 50 will be described.

Figure 4:
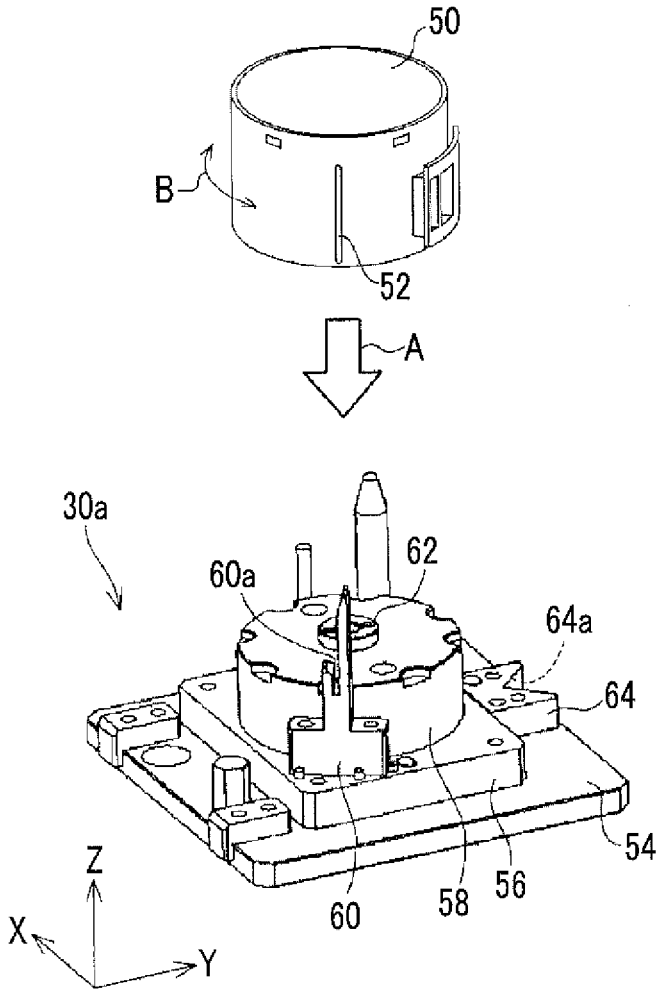
FIG. 4 is a perspective view of a print object and a jig according to the exemplary embodiment.

As illustrated in FIG. 4, the jig 30*a* includes a first base 58 for mounting the print object 50, and a second base 56 in which the first base 58 is provided.

The outer shape of the upper surface of the first base 58 corresponds to the internal shape of the lower surface of the print object 50. Further, a central positioning projection 62 for positioning the center position of the print object 50 is provided on the upper surface of the first base. Meanwhile, a groove corresponding to the shape of the central positioning projections 62 (not illustrated) is provided in the lower surface of the print object 50. In this arrangement, when the print object 50 is placed over the first base 58 in the direction of an arrow A in FIG. 4, the print object 50 is positioned in relation to the first base 58, by the central positioning projection 62 fitting into the groove.

Figure 5:
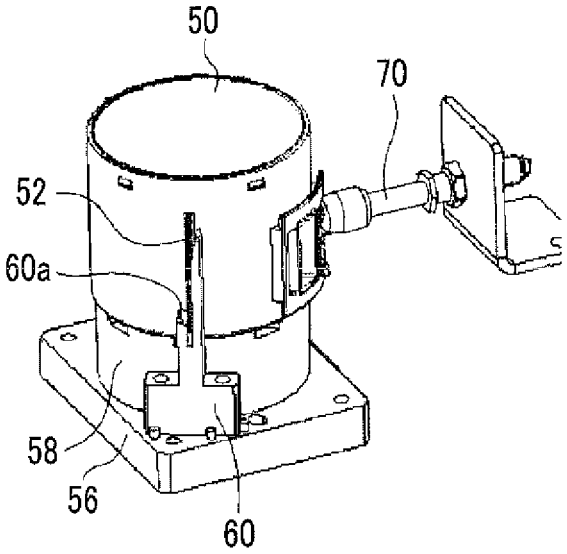
FIG. 5 is a perspective view illustrating a state where the print object according to the exemplary embodiment is placed in the jig.

A rotation suppressing member 60 for suppressing the rotation on the horizontal plane of the print object 50 placed on the first base 58 is provided in the second base 56. Specifically, as illustrated in FIG. 4 and FIG. 5, a plate-shaped protrusion 52 extending upwardly is provided in the print object 50 and a groove 60*a* extending upward is provided in the rotation suppressing member 60. Then, the rotation on the horizontal plane of the print object 50, that is, the rotation in the direction of an arrow B in FIG. 4, with the groove of the print object 50 as an axis, is suppressed by the protrusion 52 fitting into the groove 60*a*. Since a slack is provided in the width of the groove 60*a* in such a manner that the protrusion 52 of the print object 50 is smoothly fitted into the groove 60*a*, the rotation of the print object 50 is not reliably prevented by the rotation suppressing member 60, and becomes rotatable by the size of the slack.

Figure 6A:
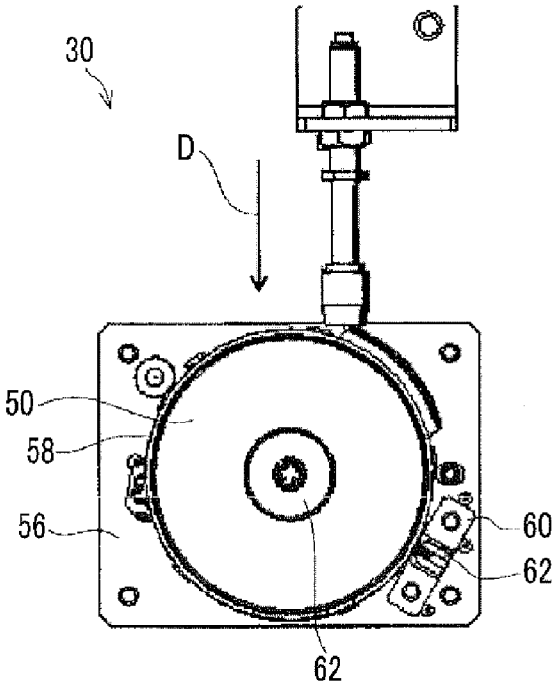
FIG. 6A is a plan view illustrating a state where the print object according to the exemplary embodiment is positioned.
Figure 6B:
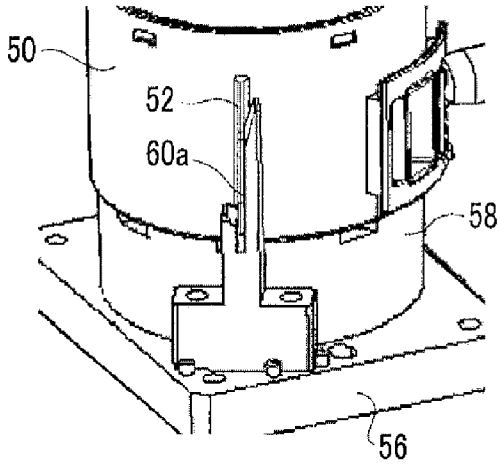
FIG. 6B is a perspective view illustrating a state where the print object according to the exemplary embodiment is positioned.

Further, as illustrated in FIG. 6A and FIG. 6B, a cylindrical pressing unit 70 extending in a separable direction (in the direction D of FIG. 6A) in relation to the print object 50 is provided in the vicinity of the printing object position where the print object 50 is positioned. The pressing unit 70 is movable in the direction D by an air cylinder 68, but the moving method of the pressing unit 70 does not depend thereon. Further, a detection unit for detecting the completion of movement is provided in the air cylinder 68.

As described above, the rotation on the horizontal plane of the print object 50 is suppressed by the rotation suppressing member 60, and the print object 50 is positioned in relation to the jig 30*a* by the pressing unit 70.

Next, the time chart of the positioning unit 30 and the printing unit 34 in the printing apparatus 10 according to the present exemplary embodiment will be described.

Figure 7A:
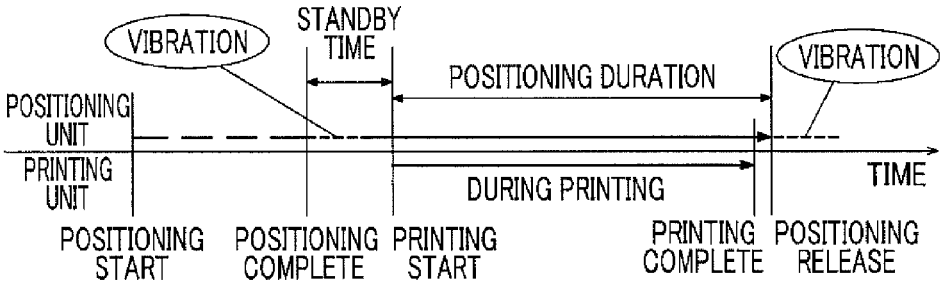
FIG. 7A is a time chart of a positioning unit and a printing unit of the exemplary embodiment, which illustrates an example of a state where vibration does not occur during printing.

As illustrated in FIG. 7A, when printing is performed successively on plural print objects 50, the printing apparatus 10 according to the present exemplary embodiment performs positioning of the print objects 50, and until a predetermined standby time has elapsed after the positioning of the print objects 50, the printing apparatus 10 is on standby. Then, the printing apparatus 10 starts the printing on the print objects 50 after the standby time has elapsed. The printing apparatus 10 is on standby until the standby time has elapsed and then starts the printing in order to avoid deterioration in the quality of the print image printed on the print objects 50 due to the vibration of the print objects 50 caused by the positioning.

Further, the printing apparatus 10 is on standby until a predetermined positioning duration (hereinafter, referred to as "duration") has elapsed, and the duration includes a time from the start of the printing to the completion of the printing. Then, the printing apparatus 10 releases the positioning of the print object 50 after the duration has elapsed. The positioning is released after the duration has elapsed in order to avoid a decrease in the quality of the print image printed on the print object 50 due to the vibration of the print object 50 caused by the release of the positioning.

In addition, information indicating an initial value of the standby time and an initial value of the duration is stored in advance in the nonvolatile memory 20.

Figure 7B:
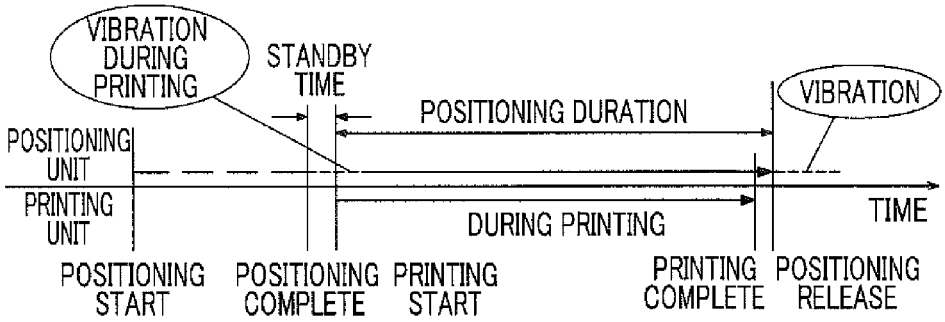
FIG. 7B is a time chart of the positioning unit and the printing unit of the exemplary embodiment, which illustrates an example of a state where vibration occurs during printing.

Here, in order to shorten the time taken for the continuous printing on the plural print objects 50, it is desirable to set the standby time from the completion of the positioning to the start of the printing to be as short as possible. Meanwhile, if the standby time is excessively short, the printing is started before the positioning is not completed, and as illustrated in FIG. 7B, the printing may be started in some cases before the print object 50 is stopped after the completion of the positioning.

Figure 7C:
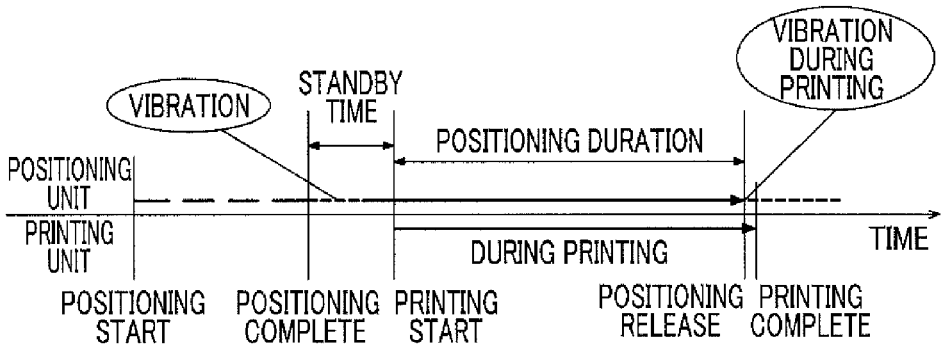
FIG. 7C is a time chart of the positioning unit and the printing unit of the exemplary embodiment, which illustrates another example of a state where vibration occurs during printing.

Further, similarly, in order to shorten the time of continuous printing on the plural print objects 50, it is desirable to reduce the duration of the positioning from the completion of the printing to the release of the positioning as much as possible. Meanwhile, as illustrated in FIG. 7C, if the duration is excessively short, the positioning may be released in some cases even though the printing is not completed.

Figure 8A:
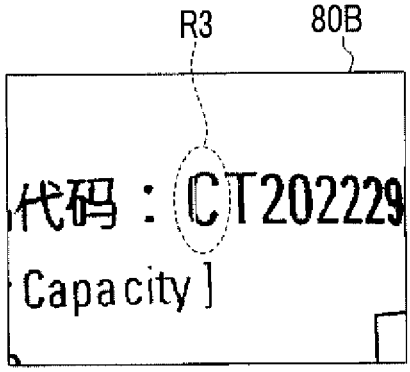
FIG. 8A is a print image printed by the printing apparatus according to the exemplary embodiment, and is a front view illustrating an example of a case where vibration occurs during printing.
Figure 8B:
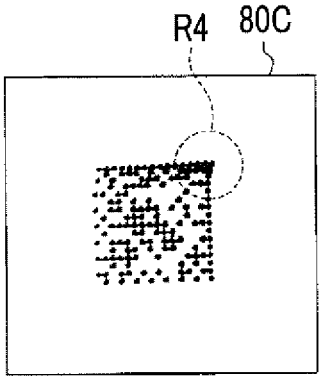
FIG. 8B is a print image printed by the printing apparatus according to the exemplary embodiment, and is a front view illustrating another example of a case where vibration occurs during printing.

In these cases, as illustrated in a dashed region R3 in FIG. 8A, a portion of a print image 80B is divided, or as illustrated in a dashed region R4 in FIG. 8B, a portion of a print image 80C is distorted, and thus the quality of the print image becomes lower in some cases. Further, since the time required for the positioning and the time required for the release of the positioning vary due to loosening of screws provided in the air cylinder 68, the abnormality of a pump, and the like, it is desirable to adjust the standby time and the duration.

Thus, the printing apparatus 10 of the present exemplary embodiment performs a printing process of adjusting the standby time, depending on the quality of the print image printed on the print object 50 by the printing unit 34, and printing the print image on the subsequent print object 50, after the elapse of the adjusted standby time.

Figure 9:
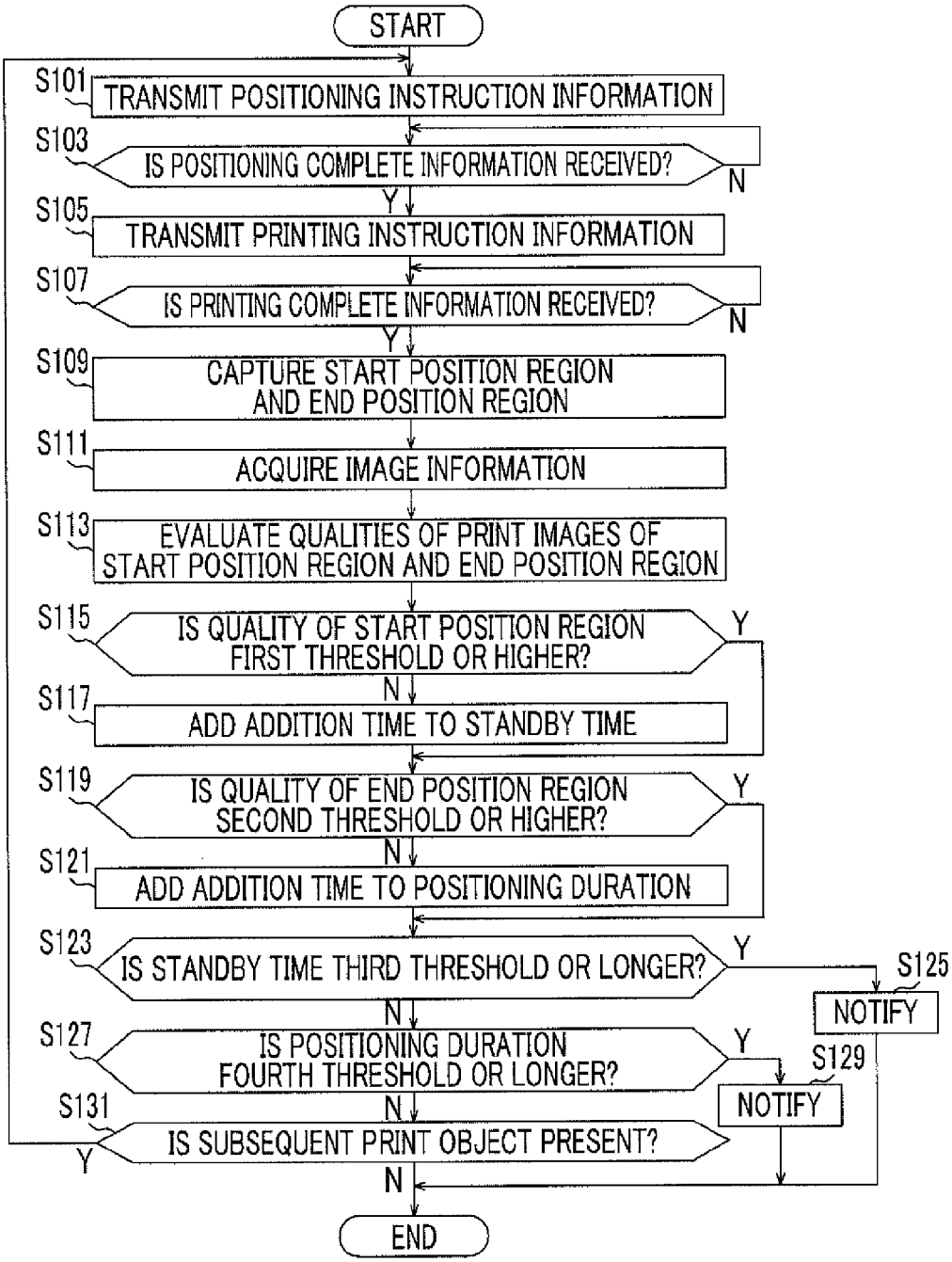
FIG. 9 is a flowchart illustrating a process flow of a printing program according to a first exemplary embodiment.
Figure 10:
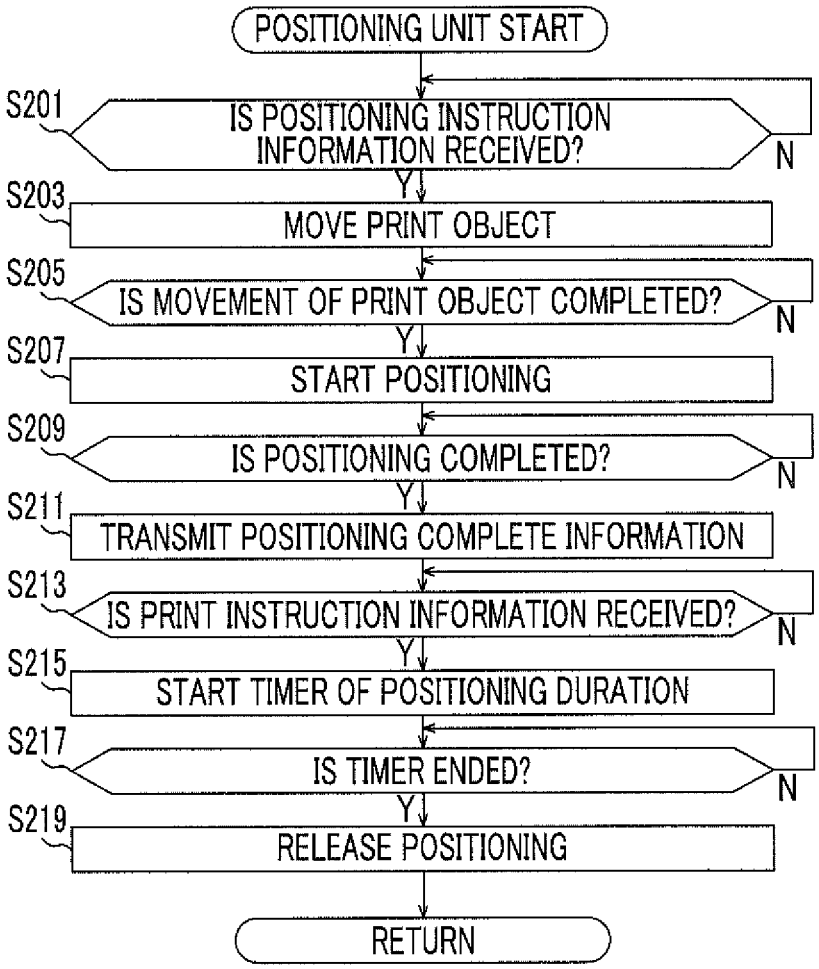
FIG. 10 is a flowchart illustrating a process flow of a routine program executed by a positioning unit according to the first exemplary embodiment.
Figure 11:
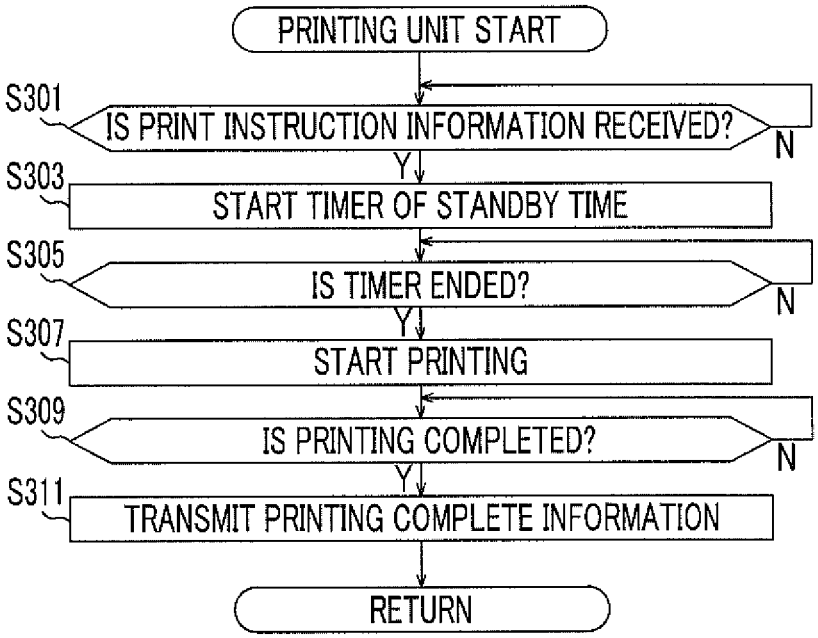
FIG. 11 is a flowchart illustrating a process flow of a routine program executed by a printing unit according to the first exemplary embodiment.

Next, the printing process flow to be executed, for example, when the CPU 14 of the printing apparatus 10 according to the present exemplary embodiment receives an execution instruction through the operation unit 24 will be described with reference to the flowcharts illustrated in FIG. 9 to FIG. 11. The flowchart illustrated in FIG. 9 is a flowchart illustrating a process flow of a main program of the printing process executed by the CPU 14. Further, the flowchart illustrated in FIG. 10 is a flowchart illustrating a process flow of a routine program executed by the positioning unit 30. Further, the flowchart illustrated in FIG. 11 is a flowchart illustrating a process flow of a routine program executed by the printing unit 34.

In addition, in the present exemplary embodiment, the printing process program is stored in advance in the nonvolatile memory 20, but is not limited thereto. For example, the printing process program may be received from an external device through the communication unit 28, and stored in the nonvolatile memory 20. Further, a printing process program recorded in a recording medium such as a CD-ROM may be read through the I/O interface 22 by the CD-ROM drive or the like.

Further, in the printing apparatus 10 according to the present exemplary embodiment, the initial value of the standby time is set to 0.5 seconds as an example, and the initial value of the duration is set to the time obtained by adding 0.2 seconds to the print time based on the moving time of the laser head in accordance with the image information of the print image, as an example.

First, the process performed by the CPU 14 will be described based on the flowchart illustrated in FIG. 9.

In step S101, positioning instruction information for instructing the positioning of the print object 50 is transmitted to the positioning unit 30, and the positioning unit 30 performs the positioning of the print object 50. In addition, if the positioning instruction information is received, the positioning unit 30 performs positioning by the process of steps S201 to S213 described later, and if the positioning is completed, positioning complete information is replied by the process of step S215 described later.

In the subsequent step S103, it is determined whether or not positioning complete information is received from the positioning unit 30. When the positioning complete information is received in step S103 (S103, Y), the process proceeds to step S105; and when the positioning complete information is not received (S103, N), the process is on standby until the positioning complete information is received.

In step S105, printing instruction information for instructing the printing is transmitted to the printing unit 34. In addition, if the printing instruction information is received, the printing unit 34 performs printing by the process of steps S301 to S309 described later, and if the printing is completed, printing complete information is replied by the process of step S311 described later.

In the subsequent step S107, it is determined whether or not printing complete information is received from the printing unit 34. When the printing complete information is received in step S107 (S107, Y), the process proceeds to step S109; and when the positioning complete information is not received (S107, N), the process is on standby until the positioning complete information is received.

In step S109, the first imaging unit 38A is controlled so as to capture the start position region R1, and the second imaging unit 38B is controlled so as to capture the end position region R2. Thus, because a decrease in the print image is caused by not performing the positioning at the time of printing start or printing end in many cases, only the start position and the end position are captured and the region therebetween is not captured. In other words, this is because if the printing may be normally performed at the time of printing start and at the time of printing end, the printing for the middle region is highly likely to be performed normally.

In the subsequent step S111, the image information regarding the first print image captured by the first imaging unit 38A in step S109 and the image information regarding the second print image captured by the second imaging unit 38B are acquired.

In the subsequent step S113, the qualities of the first print image and the second print image are evaluated. In the present exemplary embodiment, as an example, a histogram of the pixel value of each pixel for each of the first print image and the second print image is generated from the image information acquired in step S111, the contrast is derived, and an evaluation value is generated in which the higher the derived contrast is, the higher the quality is. In addition, at the time of the derivation of the contrast is, a known technology may be used.

In the subsequent step S115, it is determined whether or not the quality of the first print image is a predetermined first threshold or higher. In the present exemplary embodiment, the first threshold is set to a lower limit of a range in which the quality of the print image is determined not to be decreased with the human vision as an example, and is a numerical value obtained in advance by an experiment or the like. When the quality is determined to be the first threshold in step S115 (S115, Y) or higher, the process proceeds to step S119; and when it is determined to be lower than the first threshold (S115, N), the process shifts to step S117.

In step S117, a predetermined addition time is added to the standby time. The addition time is an addition time for increasing the standby time step by step, and in the present exemplary embodiment, the addition time is 0.1 seconds as an example that is shorter than the standby time.

In the subsequent step S119, it is determined whether or not the quality of the second print image is a predetermined second threshold or higher. In the present exemplary embodiment, the second threshold is set to a lower limit of a range in which the quality of the print image is determined not to be decreased with the human vision, as an example, and is a numerical value obtained in advance by experiments or the like. When the quality is determined to be the second threshold in step S119 (S119, Y) or higher, the process proceeds to step S123; and when it is determined to be lower than the second threshold (S119, N), the process shifts to step S121.

In step S121, a predetermined addition time is added to the duration. The addition time is an addition time for increasing the standby time step by step, and in the present exemplary embodiment, the addition time is 0.1 seconds as an example that is shorter than the duration.

In step S123, it is determined whether or not the standby time is a predetermined third threshold or longer. In addition, the third threshold is an upper limit of a range that does not affect the cycle time, and in the present exemplary embodiment, the third threshold is 0.5 seconds as an example. When the quality is determined to be the third threshold in step S123 (S123, Y) or higher, the process proceeds to step S125; and when it is determined to be lower than the third threshold (S123, N), the process proceeds to step S127.

In step S125, the notifying unit 42 is controlled so as to notify the user that the standby time is the third threshold or longer, by executing at least one out of making a predetermined beep, outputting a sound indicating that the standby time is the third threshold or longer, vibrating, and the like. The user receives this notification, and is prompted to repair the loosening of the screws provided in the air cylinder 68, the abnormality of the pump, and the like. In addition, a notification method is not limited to the notification by the notifying unit 42, the notification may be performed only by displaying on the display 26, and the notification may be performed by displaying on the display 26 and by the notifying unit 42.

In step S127, it is determined whether or not the duration is a predetermined fourth threshold or longer. In addition, the fourth threshold is an upper limit of a range that does not affect the cycle time, and in the present exemplary embodiment, the fourth threshold is a time obtained by adding 0.5 seconds to the print time, as an example. When the duration is determined to be the fourth threshold in step S127 (S127, Y) or longer, the process proceeds to step S129; and when it is determined to be shorter than the fourth threshold (S127, N), the process shifts to step S131.

In step S129, the notifying unit 42 is controlled so as to notify the user that the duration is the fourth threshold or longer, by executing at least one out of making a predetermined beep, outputting a sound indicating that the standby time is the fourth threshold or longer, vibrating, and the like. The user receives this notification, and is prompted to repair the loosening of the screws provided in the air cylinder 68, the abnormality of the pump, and the like. In addition, a notification method is not limited to the notification by the notifying unit 42, the notification may be performed only by displaying on the display 26, and the notification may be performed by displaying on the display 26 and by the notifying unit 42.

In step S131, it is determined whether a subsequent print object 50 is present. When it is determined that the subsequent print object 50 is present in step S131 (S131, Y), the process proceeds to step S101. In contrast, when it is determined that the subsequent print object 50 is not present in step S131, in other words, the printing on all of the print objects 50 is performed (S131, N), the execution of the program is ended.

Next, the process performed by the positioning unit 30 will be described based on the flowchart illustrated in FIG. 10.

In step S201, it is determined whether or not positioning instruction information transmitted in step S101 is received. When the positioning instruction information is received in step S201 (S201, Y), the process proceeds to step S203; and when the positioning instruction information is not received (S201, N), the process is on standby until the positioning instruction information is received.

In step S203, the movement of the print object 50 is started. In the present exemplary embodiment, the print object 50 is moved, and the print object 50 is positioned in the printing object position by the printing unit 34. In the present exemplary embodiment, the movement prompts the user to move the print object 50, for example, by the indication of the display 26, the user manually performs the movement, but it is not limited thereto, the movement of the print object may be performed by the transport device.

In the subsequent step S205, it is determined whether or not the movement started in step S203 is completed. When it is determined that the movement is completed in step S205 (S205, Y), the process proceeds to step S207; and when it is determined that the movement is not completed (S205, N), the movement continues until the movement is completed.

In step S207, the positioning of the print object 50 relative to the jig 30*a* is started. In the present exemplary embodiment, the pressing unit 70 is moved in a direction approaching the print object 50 by the air cylinder, and the positioning is performed by pressing the pressing unit 70 against the side of the print object 50.

In step S209, it is determined whether the positioning is completed. In the present exemplary embodiment, when the stop is detected by the detecting unit provided in the air cylinder 68, it is determined that the positioning is completed. When it is determined that the positioning is completed in step S209 (S209, Y), the process proceeds to step S211, and when it is determined that the positioning is not completed (S209, N), the positioning continues to complete the positioning.

In step S211, positioning complete information indicating the positioning is completed is transmitted to the CPU 14.

In the subsequent step S213, it is determined whether or not print instruction information transmitted in step S105 is received. When the print instruction information is received in step S213 (S213, Y), the process proceeds to step S215; and when the print instruction information is not received (S213, N), the process is on standby until the print instruction information is received.

In step S215, information indicating the duration stored in the RAM 18 is acquired, and the timer of the duration is started. The standby time is a duration after addition when the addition time is added in step S121; and the standby time is the initial value of the duration when the addition time is not added in step S121.

In step S217, it is determined whether or not the timer started in step S215 is ended. When it is determined that the timer is ended in step S217 (S217, Y), the process proceeds to step S219; and when the timer is not ended (S217, N), the process is on standby until the timer is ended.

In step S219, the positioning performed in steps S201 to S209 is released. In the present exemplary embodiment, the pressing unit 70 is moved in a direction away from the print object 50 by the air cylinder, and the positioning is released by separating the pressing unit 70 from the print object 50, and thus the execution of this routine program is ended.

Next, the process performed by the printing unit 34 will be described based on the flowchart illustrated in FIG. 11.

In step S301, it is determined whether or not print instruction information transmitted in step S105 is received. When the print instruction information is received in step S301 (S301, Y), the process proceeds to step S303; and when the print instruction information is not received (S301, N), the process is on standby until the print instruction information is received.

In step S303, information indicating the standby time stored in the RAM 18, and the timer of the standby time is started. The standby time is a standby time after addition when the addition time is added in step S117; and the standby time is the initial value of the standby time when the addition time is not added in step S117.

In the subsequent step S305, it is determined whether or not the timer started in step S303 is ended. When the timer is ended in step S303 (S305, Y), the process proceeds to step S307, and when the timer is not ended (S305, N), the process is on standby until the timer is ended.

In step S307, the printing of the print image on the print object 50 is started.

In the subsequent step S309, it is determined whether the printing has been completed. When it is determined that the printing has been completed in step S309 (S309, Y), the process proceeds to step S311; and when it is determined that the printing has not been completed (S309, N), the printing continues.

In step S311, printing complete information indicating the printing has been completed is transmitted to the CPU 14, and the execution of this routine program is ended.

Second Exemplary Embodiment

Next, a printing apparatus according to a second exemplary embodiment will be described.

Since the printing apparatus according to the second exemplary embodiment is the same as the printing apparatus 10 according to the first exemplary embodiment, a description for each component will be omitted.

In the first exemplary embodiment, a description has been made regarding the case where the standby time or the duration is lengthened depending on the quality of the print image. Meanwhile, in the second exemplary embodiment, a description will be made regarding the case where the standby time or the duration is lengthened or shortened depending on the quality of the print image.

In addition, since the process flow of a routine program executed by the positioning unit 30 and the process flow of a routine program executed by the printing unit 34 are the same as those in the first exemplary embodiment, a description of each process flow will be omitted.

Figure 12:
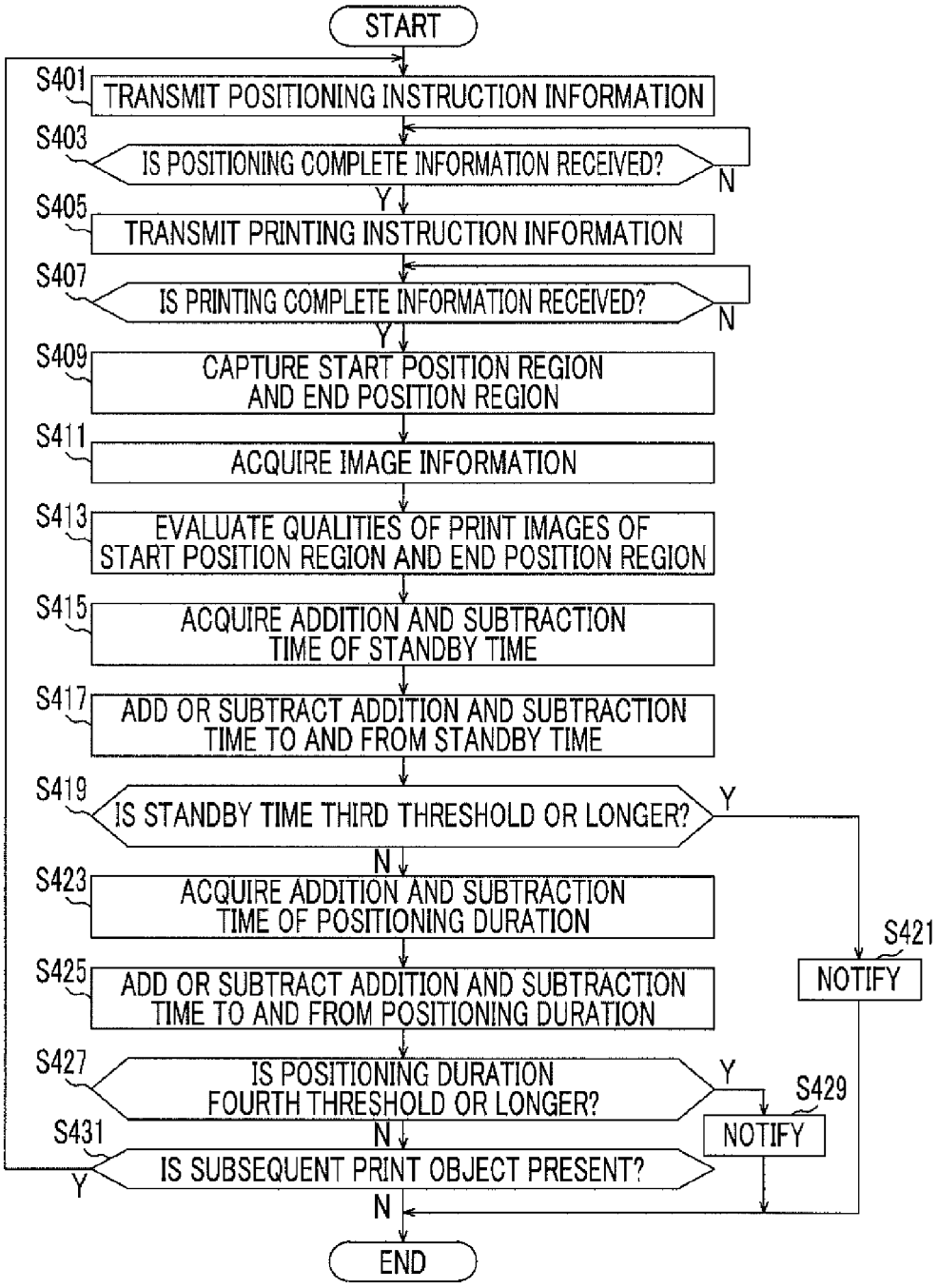
FIG. 12 is a flowchart illustrating a process flow of a printing program according to a second exemplary embodiment.

Next, the printing process flow executed, for example, when the CPU 14 of the printing apparatus 10 according to the present exemplary embodiment receives an execution instruction through the operation unit 24 will be described with reference to the flowchart illustrated in FIG. 12.

In addition, in the present exemplary embodiment, the printing process program is stored in advance in the nonvolatile memory 20, but is not limited thereto. For example, the printing process program may be received from an external device through the communication unit 28, and stored in the nonvolatile memory 20. Further, a printing process program recorded in a recording medium such as a CD-ROM may be read through the I/O interface 22 by the CD-ROM drive or the like.

Further, in the printing apparatus 10 according to the present exemplary embodiment, the initial value of the standby time is set to 0.5 seconds as an example, and the initial value of the duration is set to the time obtained by adding 0.2 seconds to the print time based on the moving time of the laser head in accordance with the image information of the print image, as an example.

In steps S401 to S413, the same process as the process of steps S101 to S113 of the first exemplary embodiment is performed.

In the subsequent step S415, the addition and subtraction time of the standby time is acquired. In the present exemplary embodiment, the evaluation values generated in step S413 are classified into grades A to E, and the addition and subtraction time of the standby time is acquired by using the correspondence information 82, as illustrated in FIG. 13 representing the correspondence between the classified grade and the addition and subtraction time. In addition, correspondence information 82 is stored in advance in the nonvolatile memory 20. Further, the quality of the classified grade becomes gradually lower, for example, in the order of a grade A (100% or less to 96% or more), a grade B (less than 96% to 92% or more), a grade C (less than 92% to 88% or more), a grade D (less than 88% to 84% or more), and a grade E (less than 84% to 0% or more). The CPU 14 obtains the addition and subtraction time that is associated with the quality of the first print image evaluated in step S413, from the correspondence information 82.

Here, when the quality of print image is classified into a grade, evaluation is quantified with using, for example, degree of similarity between images: to quantify using a ratio obtained based on how many pixels are similar with each other or are in a range of similarity by comparing a pixel value (color) of a captured image and a pixel value (color) of an ideal image;

contrast (brightness) of image: to quantify using a ratio obtained based on how many times a pixel value of a captured image is as large as a pixel value of an ideal image;

printing accuracy of code: to quantify using a read stability of a bar code or a two-dimensional code, which is dependent on a function of an image processor which is used.

In step S417, the addition and subtraction time obtained in step S415 is added to or subtracted from the standby time. For example, if the quality of the print image is the grade A, 0.2 seconds are subtracted from the standby time; and if the quality of the print image is the grade B, 0.1 seconds are subtracted from the standby time. Further, if the quality of the print image is the grade D, 0.1 seconds are added to the standby time; and if the quality of the print image is the grade E, 0.2 seconds are added to the standby time. In addition, if the quality of the print image is the grade C, addition or subtraction is not performed for the standby time.

In the subsequent step S419, it is determined whether the standby time is the third threshold or longer. When the standby time is determined to be the third threshold in step S419 (S419, Y) or longer, the process proceeds to step S421; and when the standby time is shorter than the third threshold (S419, N), the process proceeds to step S423.

In step S421, the notifying unit 42 is controlled so as to notify the user that the standby time is the third threshold or longer, by executing at least one out of making a predetermined beep, outputting a sound indicating that the standby time is the third threshold or longer, vibrating, and the like. The user receives this notification, and is prompted to repair the loosening of the screws provided in the air cylinder 68, the abnormality of the pump, and the like. In addition, a notification method is not limited to the notification by the notifying unit 42, the notification may be performed only by displaying on the display 26, and the notification may be performed by displaying on the display 26 and by the notifying unit 42.

In the subsequent step S423, the addition and subtraction time of the duration is acquired. In the present exemplary embodiment, the CPU 14 obtains the addition and subtraction time that is associated with the quality of the second print image evaluated in step S413, from the correspondence information 82.

In step S425, the addition and subtraction time obtained in step S423 is added to or subtracted from the duration. For example, if the quality of the print image is the grade A, 0.2 seconds are subtracted from the duration; and if the quality of the print image is the grade B, 0.1 seconds are subtracted from the duration. Further, if the quality of the print image is the grade D, 0.1 seconds are added to the duration; and if the quality of the print image is the grade E, 0.2 seconds are added to the duration. In addition, if the quality of the print image is the grade C, addition or subtraction is not performed for the duration.

In step S427, it is determined whether the duration is the fourth threshold or longer. When the duration is determined to be the fourth threshold in step S427 (S427, Y) or longer, the process proceeds to step S429; and when the duration is determined to be shorter than the fourth threshold (S427, N), the process proceeds to step S431.

In step S429, the notifying unit 42 is controlled so as to notify the user that the duration is the fourth threshold or longer, by executing at least one out of making a predetermined beep, outputting a sound indicating that the duration is the fourth threshold or longer, vibrating, and the like. The user receives this notification, and is prompted to repair the loosening of the screws provided in the air cylinder 68, the abnormality of the pump, and the like. In addition, a notification method is not limited to the notification by the notifying unit 42, the notification may be performed only by displaying on the display 26, and the notification may be performed by displaying on the display 26 and by the notifying unit 42.

In step S431, it is determined whether a subsequent print object 50 is present. When it is determined that the subsequent print object 50 is present in step S431 (S431, Y), the process proceeds to step S401. In contrast, when it is determined that the subsequent print object 50 is not present in step S431, in other words, the printing on all of the print objects 50 is performed (S431, N), the execution of the program is ended.

Third Exemplary Embodiment

Next, a printing apparatus according to a third exemplary embodiment will be described.

Since the printing apparatus according to the third exemplary embodiment is the same as the printing apparatuses 10 according to the first exemplary embodiment and the second exemplary embodiment, a description for each component will be omitted.

In the second exemplary embodiment, a description has been made regarding the case where the standby time or the duration is lengthened or shortened depending on the quality of the print image. Meanwhile, in the third exemplary embodiment, a description will be made regarding the case where the standby time or the duration is lengthened depending on the quality of the print image, when the quality of the print image is a predetermined threshold or lower.

In addition, since the process flow of a routine program executed by the positioning unit 30 and the process flow of a routine program executed by the printing unit 34 are the same as those in the first exemplary embodiment, a description of each process flow will be omitted.

Figure 14:
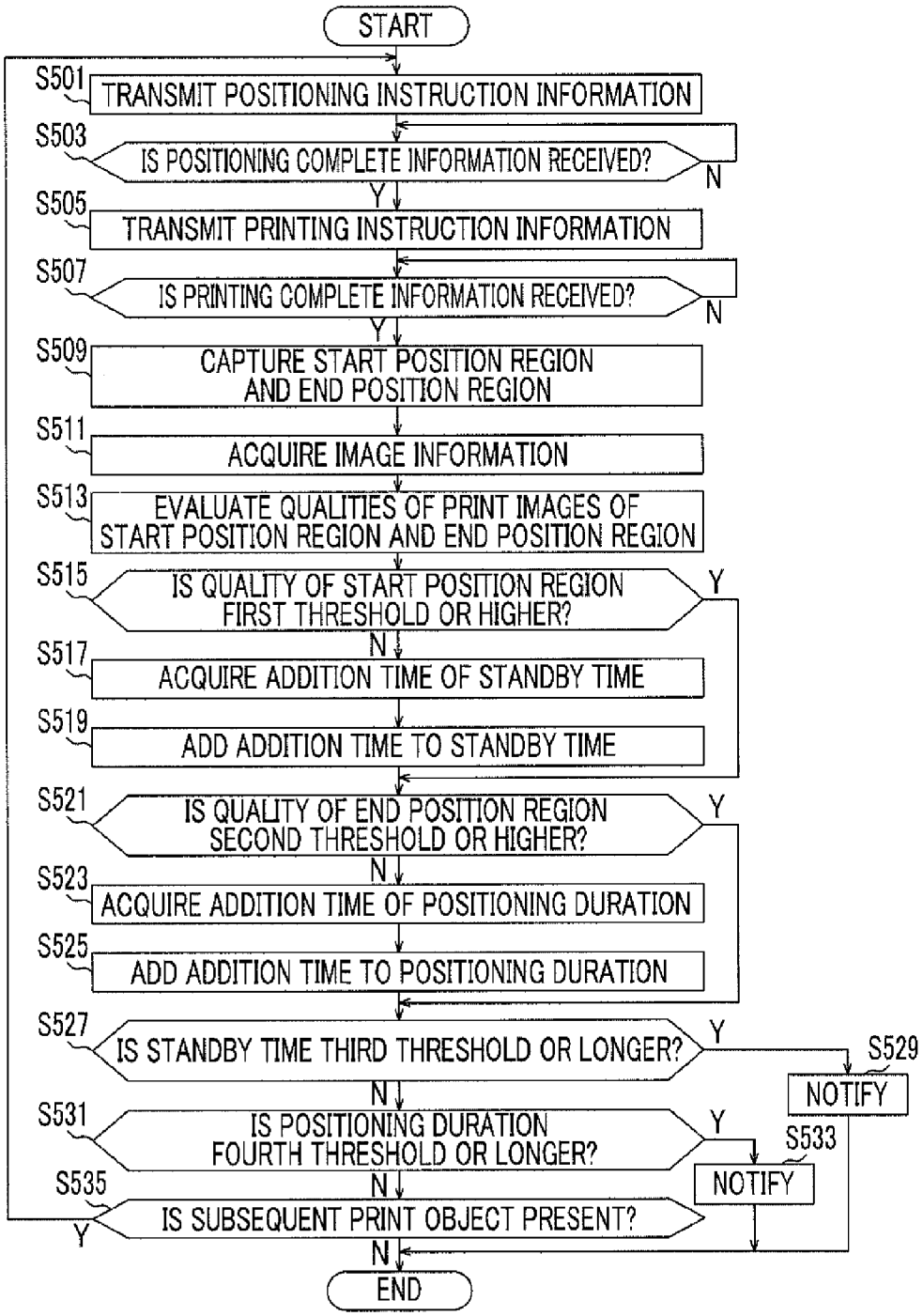
FIG. 14 is a flowchart illustrating a process flow of a printing program according to a third exemplary embodiment.

Next, the printing process flow executed, for example, when the CPU 14 of the printing apparatus 10 according to the present exemplary embodiment receives an execution instruction through the operation unit 24 will be described with reference to the flowchart illustrated in FIG. 14.

In addition, in the present exemplary embodiment, the printing process program is stored in advance in the nonvolatile memory 20, but is not limited thereto. For example, the printing process program may be received from an external device through the communication unit 28, and stored in the nonvolatile memory 20. Further, a printing process program recorded in a recording medium such as a CD-ROM may be read through the I/O interface 22 by the CD-ROM drive or the like.

Further, in the printing apparatus 10 according to the present exemplary embodiment, the initial value of the standby time is set to 0.5 seconds as an example, and the initial value of the duration is set to the time obtained by adding 0.2 seconds to the print time based on the moving time of the laser head in accordance with the image information of the print image, as an example.

In steps S501 to S513, the same process as the process of steps S101 to S113 of the first exemplary embodiment is performed.

In the subsequent step S515, it is determined whether the quality of the first print image is the first threshold or higher. When the quality of the first print image is determined to be the first threshold in step S515 (S515, Y) or higher, the process proceeds to step S521; and when the quality of the first print image is determined to be lower than the first threshold (S515, N), the process proceeds to step S517.

In step S517, the addition time of the standby time is acquired. In the present exemplary embodiment, similar to the step S415, the evaluation values generated in step S513 are classified into grades A to E, and the addition time of the standby time is acquired by using correspondence information 84, as illustrated in FIG. 15. In addition, the correspondence information 84 is stored in advance in the nonvolatile memory 20.

In step S519, the addition time obtained in step S517 is added to the standby time. For example, if the quality of the print image is the grade C, 0.1 seconds are added to the standby time; if the quality of the print image is the grade D, 0.2 seconds are added to the standby time; and if the quality of the print image is the grade E, 0.3 seconds are added to the standby time. In addition, if the quality of the print image is the grade A or B, addition is not performed for the standby time.

In the subsequent step S521, it is determined whether the quality of the second print image is the second threshold or higher. When the quality of the second print image is determined to be the second threshold in step S521 (S521, Y) or higher, the process proceeds to step S527; and when the quality of the second print image is determined to be lower than the second threshold (S521, N), the process proceeds to step S523.

In step S523, the addition time of the duration is acquired. The CPU 14 obtains the addition time that is associated with the quality of the second print image evaluated in step S513, from the correspondence information 84.

In step S525, the addition time obtained in step S523 is added to the duration. For example, if the quality of the print image is the grade C, 0.1 seconds are added to the duration; and if the quality of the print image is the grade D, 0.2 seconds are added to the duration. Further, if the quality of the print image is the grade E, 0.3 seconds are added to the duration. In addition, if the quality of the print image is the grade A or B, addition is not performed for the duration.

In subsequent steps S527 to S535, the same process as the process of steps S123 to S131 of the first exemplary embodiment is performed.

In addition, in the first exemplary embodiment to the third exemplary embodiment, the description has been made regarding the case of evaluating the quality of the print image by using the contrast, for each of the first print image and the second print image, but the evaluation is not limited thereto. For example, a histogram of a pixel value of each pixel is generated for each of the first print image and the second print image, and an evaluation value may be generated in which as the height of the peak of the pixel value of the region that is being printed and the height of the peak of the pixel value of the region that is not being printed become higher, the quality of the print image is improved.

Alternatively, the sharpness is derived for each of the first print image and the second print image, and an evaluation value may be generated in which the higher the sharpness is, the higher the quality is. In addition, at the time of the derivation of the sharpness, a known technology may be used.

Alternatively, image information indicating an ideal image of each of the first print image and the second print image is stored in the RAM 18, and an evaluation value may be generated by comparing the image obtained by the capturing and the ideal image. In this case, the degree of similarity between the image obtained by the capturing and the ideal image is calculated, and an evaluation value may be generated in which higher the degree of similarity is, the higher the quality is. Further, the degree of similarity between the image obtained by the capturing and the ideal image may be obtained, for example, by a cross-correlation coefficient of the pixel value of each pixel in the image.

Alternatively, encryption information (for example, a bar code and a two-dimensional code) is printed on the print object 50, the printed encryption information is read by the imaging unit, and the read stability may be used as an evaluation value. In this case, an evaluation value may be generated in which the higher the read stability is, the higher the quality is. In addition, at the time of the derivation of the read stability, a known technology may be used.

Further, in the first exemplary embodiment to the third exemplary embodiment, the description has been made regarding the case of using a laser emitting apparatus as the printing unit 34, but is not limited thereto, and droplet discharging unit provided with a recording head for discharging the liquid droplets may be used as a printing unit. In this case, the print object become a printable state by the droplet, a print image is drawn on the print object by the recording head moving while discharging the liquid droplets.

Further, in the first exemplary embodiment to the third exemplary embodiment, the print image 80A is captured by using two imaging units of the first imaging unit 38A and the second imaging unit 38B, but the imaging method is not limited thereto. For example, the entire print image 80A may be captured by one imaging unit, and the print image 80A may be partially captured by three or more imaging unit.

Further, in the first exemplary embodiment, the description has been made regarding the case where when the quality of print image is the threshold or less, the standby time and the duration are lengthened, but without being limited thereto, a case where when the quality of print image is the threshold or higher, the standby time and the duration are shortened may be an exemplary embodiment. In this case, the initial value of the standby time and the initial value of the duration may be the longest time that does not affect the cycle time, and when the quality of the print image is threshold or higher, a predetermined subtraction time may be subtracted from the standby time and the duration.

Further, in the first exemplary embodiment to the third exemplary embodiment, the description has been made regarding the case where the duration is set to a time from the start of printing to the release of the positioning, but the duration is not limited thereto. For example, the duration may be set to a time from the start of positioning to the release of the positioning. In this case, it is preferable that the positioning unit 30 performs the process of step S219 together with the process of step S203. Further, the duration may be set to a time from the completion of positioning to the release of the positioning. In this case, it is preferable that the positioning unit 30 performs the process of step S215 together with the process of step S211.

Further, in the second exemplary embodiment, the description has been made regarding the case where the addition and subtraction time for the standby time and the addition and subtraction time for the duration are obtained from the same correspondence information, but without being limited thereto, each piece of individual correspondence information is stored, and the addition and subtraction time may be obtained from each piece of individual correspondence information. Further, similarly, in the third exemplary embodiment, each piece of individual correspondence information is stored, for the addition time for the standby time and the addition time for the duration, and each piece of individual correspondence information may be obtained.

Further, in the second exemplary embodiment, the description has been made regarding the case where the addition and subtraction time for the standby time and the addition and subtraction time for the duration are obtained from the predetermined correspondence information, but without being limited thereto, the addition and subtraction time may be calculated using an equation representing the relationship between the quality of the print image and each addition time. Further, similarly, in the third exemplary embodiment, the description has been made regarding the case where the addition time for the standby time and the addition time for the duration are obtained from the predetermined correspondence information, but without being limited thereto, the addition time may be calculated using an equation representing the relationship between the quality of the print image and each addition time.

Further, in the first exemplary embodiment to third exemplary embodiment, the description has been made regarding the case where the printing program is executed based on the operation of the operation unit 24, but without being limited thereto, the printing program may be executed, for example, based on the reception of the execution instruction information through the communication unit 28 from an external device.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A printing apparatus comprising:

a positioning unit that positions a print object;

a printing unit that prints a predetermined print image on the print object after elapse of a predetermined standby time since the print object is positioned by the positioning unit; and a controller that adjusts the standby time depending on quality of the print image printed on the print object by the printing unit, and controls the printing unit so as to print the print image on a subsequent print object after the elapse of the adjusted standby time.

2. The printing apparatus according to claim 1, wherein the controller lengthens the standby time, when the quality of the print image is lower than predetermined quality.

3. The printing apparatus according to claim 2, wherein the controller adds a predetermined addition time to the standby time, when the quality of the print image is lower than the predetermined quality.

4. The printing apparatus according to claim 1, wherein the controller lengthens the standby time, as the quality of the print image becomes lower.

5. The printing apparatus according to claim 1, wherein the controller shortens the standby time, when the quality of the print image is higher than a predetermined quality.

6. The printing apparatus according to claim 5, wherein the controller subtracts a predetermined subtraction time from the standby time, when the quality of the print image is higher than the predetermined quality.

7. The printing apparatus according to claim 6, wherein the controller shortens the standby time, as the quality of the print image becomes higher.

8. The printing apparatus according to claim 1, wherein the controller stops the positioning by the positioning unit and the printing by the printing unit, when the adjusted standby time is longer than a predetermined threshold.

9. The printing apparatus according to claim 8, further comprising:

a notification unit that notifies stop, when the positioning by the positioning unit and the printing by the printing unit are stopped.

10. The printing apparatus according to claim 1, further comprising:

a start position capturing unit that captures a region which is a portion of the print image and includes a start position of the printing by the printing unit, wherein the controller adjusts the standby time depending on the quality of the print image based on an image captured by the start position capturing unit.

11. The printing apparatus according to claim 1, wherein the positioning unit releases the positioning of the print object, after the elapse of a predetermined positioning duration since the printing is started by the printing unit; and the controller adjusts the positioning duration depending on a quality of the print image printed on the print object by the printing unit, and controls the positioning unit such that the positioning of the print object is released after the elapse of the adjusted positioning duration, with respect to the subsequent print object.

12. The printing apparatus according to claim 11, further comprising:

an end position capturing unit that captures a region which is a portion of the print image and includes an end position of the printing by the printing unit, wherein the controller adjusts the positioning duration depending on the quality of the print image based on an image captured by the end position capturing unit.

13. A printing method comprising:

first printing a predetermined print image on a print object after elapse of a predetermined standby time since the print object is positioned;

adjusting the standby time depending on a quality of the print image printed on the print object in the first printing; and second printing the print image on a subsequent print object after the elapse of the standby time that is adjusted in the adjusting.

14. A manufacturing method of a printed matter comprising:

first manufacturing a printed matter by printing a predetermined print image on a print object after elapse of a predetermined standby time since the print object is positioned;

adjusting the standby time depending on a quality of the print image printed on the print object in the first manufacturing; and second manufacturing a printed matter by printing the print image on a subsequent print object after the elapse of the standby time that is adjusted in the adjusting.

15. The printing apparatus according to claim 1, wherein the quality of the print image printed on the print object is a quality of the print image of a start position region and an end position region.

16. The method according to claim 13, wherein the quality of the print image printed on the print object is a quality of the print image of a start position region and an end position region.

17. The manufacturing method of a printed matter according to claim 14, wherein the quality of the print image printed on the print object is a quality of the print image of a start position region and an end position region.

* * * * *